US006394679B2

(12) United States Patent
Dumler

(10) Patent No.: US 6,394,679 B2
(45) Date of Patent: May 28, 2002

(54) COSMETIC UNIT, IN PARTICULAR MASCARA UNIT

(75) Inventor: Norbert Dumler, Ansbach (DE)

(73) Assignee: Georg Karl Geka-Brush GmbH, Bechhofen-Walzendorf (DE)

( * ) Notice: Subject to any disclaimer, the term of this patent is extended or adjusted under 35 U.S.C. 154(b) by 0 days.

(21) Appl. No.: 09/860,783

(22) Filed: May 21, 2001

Related U.S. Application Data

(63) Continuation-in-part of application No. 09/615,751, filed on Jul. 13, 2000, now abandoned.

(30) Foreign Application Priority Data

Jul. 21, 1999 (DE) ..... 299 12 677 U

(51) Int. Cl.[7] ..... B43K 5/12
(52) U.S. Cl. ..... 401/194; 401/126
(58) Field of Search ..... 401/194, 195, 401/124, 129, 126; 132/218, 313, 317, 318, 320; 220/212.5, 213, 288, 336; 215/227, 228, 302, 303, 337

(56) References Cited

U.S. PATENT DOCUMENTS 2,990,834 A 7/1961 Amen
3,062,222 A 11/1962 Quinn
3,370,908 A 2/1968 Cupp
3,802,788 A * 4/1974 Danjczek ..... 401/194
3,887,115 A 6/1975 Petterson
4,422,545 A * 12/1983 Kadoory ..... 401/34
5,221,153 A 6/1993 Spatz
5,529,417 A 6/1996 Burrlader
5,810,497 A 9/1998 Bachmann et al.
5,860,755 A 1/1999 Bunk
5,941,254 A 8/1999 Heler
5,957,607 A * 9/1999 Tsai ..... 401/194

* cited by examiner

*Primary Examiner*—David J. Walczak
(74) *Attorney, Agent, or Firm*—Browdy and Neimark

(57) ABSTRACT

In a cosmetic unit, in particular a mascara unit, having a reservoir for a cosmetic and a cap to be screwed on this reservoir. The package is made attractive from an esthetic point of view by making the color of the product contained in the reservoir easily visible to the consumer. The cap has a hollow interior which is open upwards. The end face which defines the opening of the cap is diagonal to the lower end face of the cap and the opening interior of the cap has a color coating.

6 Claims, 1 Drawing Sheet

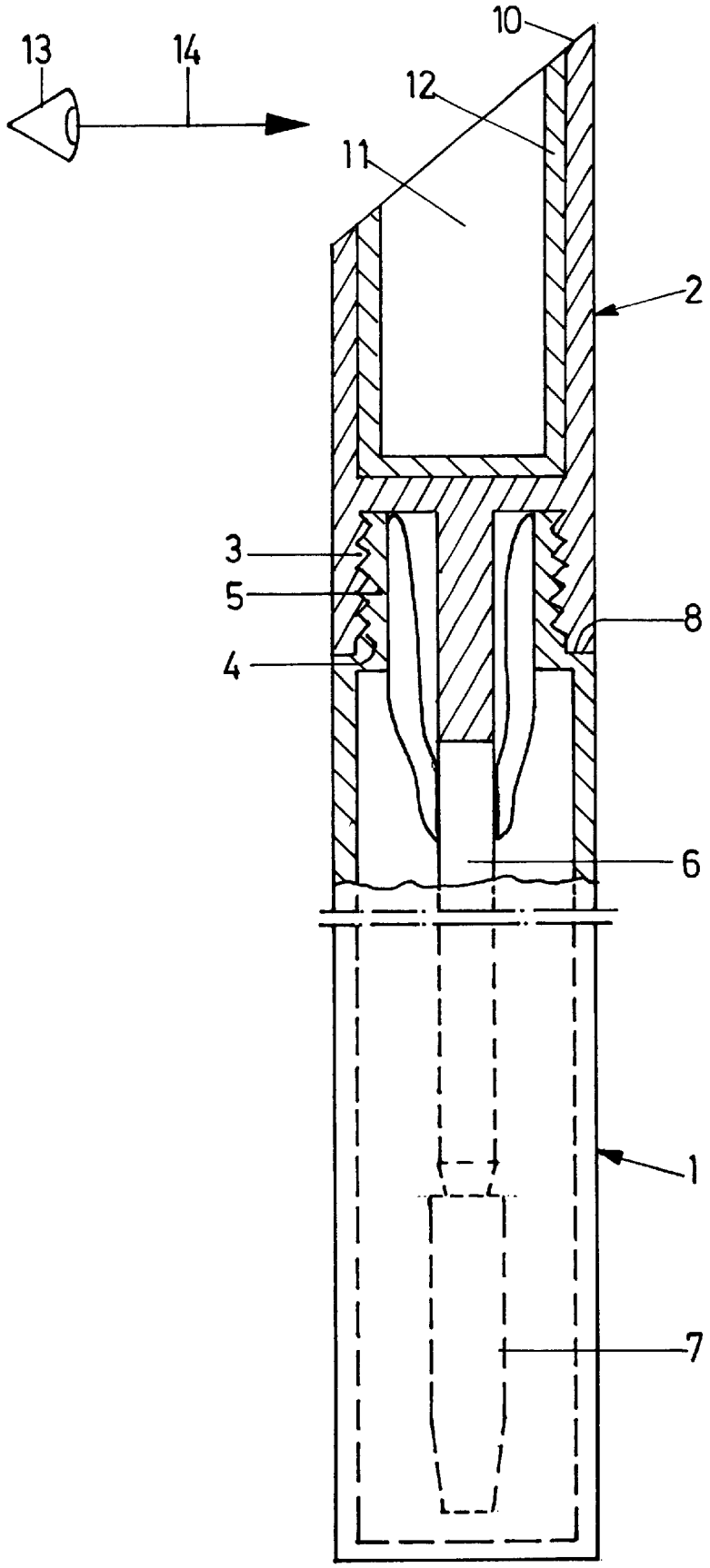
13
14
10
12
11
2
3
5
4
8
6
1
7

COSMETIC UNIT, IN PARTICULAR MASCARA UNIT

This application is continuation-in-part of Ser. No. 09/615,751 filed Jul. 13, 2000 abandoned.

BACKGROUND OF THE INVENTION

1. Field Of The Invention

The invention relates to a cosmetic unit, in particular mascara unit, comprising a reservoir for a cosmetic and a cap to be screwed on this reservoir.

2. Background Art

In mascara units of the generic type, mascara liquid is contained in the reservoir, and the stem of an applicator is mounted on the cap, the applicator plunging into the mascara liquid when the cap is screwed on.

Mascara units of the generic type, for instance for hair mascara, i.e., for the application of colored strands in the hair, are frequently offered in sales display systems where the basic body of the reservoir cannot be seen, but substantially only the cap. Moreover, opaque plastics are used in the reservoir for optimal impermeability to gas and liquid to be obtained, or the plastic body is printed for decoration or provided with a metal coating so that the color of the contents cannot be seen from outside.

SUMMARY OF THE INVENTION

It is the object of the invention to embody a cosmetic unit of the type under regard such that it is possible to make the whole package rather attractive from an esthetic point of view, but in particular to make the color of the product contained in the reservoir easily visible to the consumer wherein the reservoir is generally opaque.

According to the invention, this object is attained by the cap having a hollow interior which is open upwards, by the end face which defines the opening of the cap being diagonal of the lower end face of the cap, and by the open interior of the cap having an opaque color coating which can be in the form of a plastic layer having a color corresponding to the color of the product in the reservoir.

This design enables the consumer, immediately and without detailed studies, to recognize the cosmetic product contained in the reservoir and in particular the color thereof even when the reservoir is opaque.

By advantage, the color coating is a colored plastic layer applied by coextrusion on the basic body of the cap.

For an especially attractive appearance, the color coating may be given a metallic shine or it may be a metal part having a tinge of gold or silver.

The end face may have a marking, an embossed or printed design, it being in particular possible to form the surface of the end face approximately parallel to the longitudinal axis of the unit so that the marking is applied on the surface to be excellently visible.

In keeping with a preferred embodiment, it is provided that the end face is widened by either the wall thickness being increased in the vicinity of the end face or by the diameter being enlarged in the vicinity of the end face as opposed to the base diameter. The wall thickness of the cap may range between 1 mm and 15 mm.

Details of the invention will become apparent from the ensuing description of a preferred exemplary embodiment, taken in conjunction with the drawing.

BRIEF DESCRIPTION OF THE DRAWING

The drawing FIGURE is an illustration of a longitudinal section through a cosmetic unit according to the invention.

DESCRIPTION OF THE PREFERRED EMBODIMENT

A cosmetic unit seen in the drawing comprises a reservoir 1 (roughly outlined diagrammatically) for a cosmetic and a cap 2 which, by an internal thread 3, is screwed on an external thread 4 provided on a neck 5 of tapered cross section of the reservoir 1. The cap 2 may also be formed from the same opaque material as the reservoir 1.

The stem 6 of an applicator 7 is mounted on the cap 2, projecting beyond the lower end face 8 of the cap 2 so that the applicator 7 plunges into the cosmetic contained in the reservoir 1 when the cap 2 is screwed on.

The upper end face 10 of the cap 2 is diagonal of the lower end face 8 and of the longitudinal axis of the cosmetic unit, respectively. This upper end face 10 is annular and encloses an interior 11 which is provided by coextrusion with an opaque plastic layer 12, the color of which corresponds to the color of the cosmetic in the reservoir 1. Due to the fact that the upper end face 10 is diagonal, a viewer symbolized by the eye 13, when looking straight in the direction of the arrow 14, will recognize the color of the plastic layer 12 without any difficulties and will consequently be able to recognize the color of the contents without any problem even if the cosmetic unit is placed on a shelf or in a display system. Moreover, an especially attractive design is obtained by the cap 2 being embodied as specified above.

What is claimed is:

1. A cosmetic unit comprising a reservoir for a cosmetic and a cap to be screwed on this reservoir, wherein the cap (2) has a hollow interior (11) which is open upwards; wherein a face (10) which defines an opening to the hollow interior of the cap (2) is diagonal to a lower end face (8) of the cap (2); and wherein the hollow interior (11) of the cap (2) has a color coating around a circumference of the hollow interior formed by an opaque colored plastic layer or metal part (12) extending to the opening of the hollow interior.

2. A cosmetic unit according to claim 1, wherein the colored plastic layer (12) is applied by coextrusion on the cap (2).

3. A cosmetic unit according to claim 1, wherein the color coating has a metallic shine or is a metal part having a tinge of gold or silver.

4. A cosmetic unit according to claim 1, wherein the reservoir is opaque.

5. A cosmetic unit according to claim 1, wherein the cap is opaque.

6. A cosmetic unit according to claim 1, wherein both the reservoir and the cap are opaque.

* * * * *